United States Patent [19]

Schweiger et al.

[11] Patent Number: 4,510,893

[45] Date of Patent: Apr. 16, 1985

[54] COOLING CIRCUIT FOR INTERNAL COMBUSTION ENGINES

[75] Inventors: Erwin Schweiger, Dachau; Erwin Starmuehler, Munich; Axel Temmesfeld, Bad Feilnbach, all of Fed. Rep. of Germany

[73] Assignee: Bayerische Motoren Werke AG, Fed. Rep. of Germany

[21] Appl. No.: 513,802

[22] Filed: Jul. 14, 1983

[30] Foreign Application Priority Data

Jul. 15, 1982 [DE] Fed. Rep. of Germany ..... 3226508

[51] Int. Cl.[3] ..... F01P 7/16

[52] U.S. Cl. ..... 123/41.02; 123/41.1; 123/41.27; 123/41.54

[58] Field of Search ..... 123/41.02, 41.08, 41.09, 123/41.1, 41.27, 41.44, 41.54

[56] References Cited

U.S. PATENT DOCUMENTS

| | | | |
|---|---|---|---|
| Re. 27,965 | 4/1974 | Avrea | 123/41.27 |
| 2,067,924 | 1/1937 | Illsley | 123/41.1 |
| 3,132,634 | 5/1964 | Butler | 123/41.54 |
| 3,981,279 | 9/1976 | Bubniak et al. | 123/41.02 |
| 4,167,159 | 9/1979 | Warman | 123/41.08 |

*Primary Examiner*—William A. Cuchlinski, Jr.
*Attorney, Agent, or Firm*—Craig & Burns

[57] ABSTRACT

Cooling circuit for internal combustion engines, with an excess-pressure valve which, when the cooling circuit is under full thermal load, limits the pressure in the feed to a value at which the pressure on the suction side of the coolant pump is always above the boiling pressure of the cooling medium, even at full delivery level of the coolant pump. The efficiency of the cooling function is improved as also the structural expenditure in connection with the cooling circuit is reduced thereby and also by the central arrangement, in the filling stub, respectively, the cap thereof, of additional excess-pressure and vacuum valves, of a throttle for a venting flow, of a level float switch for the filling level indication in the cooling circuit and of a blocking device against the opening of the cap which is under pressure.

28 Claims, 5 Drawing Figures

COOLING CIRCUIT FOR INTERNAL COMBUSTION ENGINES

The present invention relates to a cooling circuit for internal combustion engines with a cooling medium pump, with a radiator, with a radiator valve of a thermostat and with an excess-pressure valve. In cooling circuits of this type, it is customary to arrange an excess-pressure valve and a vacuum valve in the filling closure cap. For the use of an operating temperature of the cooling medium composed of water, antifreeze, and corrosion-protective agent, which lies above the boiling temperature at atmospheric pressure, excess-pressure valves are used having an opening value of about 0.8–1.5 bar excess pressure. The filling caps and the excess-pressure valves are arranged either in the feed or in the return of the cooling circuit, for example, shortly after the discharge from the cooling jacket of the engine and after the radiator valve of a thermostat arranged thereat in the feed line itself, in the feed or return water boxes of vertical or cross-flow radiators or also in an expansion tank absorbing the thermal expansion of the coolant with an air cushion, which respectively serves for the collection and discharge of air, and which includes a bypass flow- and filling connecting line to the intake side of the coolant pump.

In the arrangement of the excess-pressure valve in the feed or intake area of the cooling circuit, a drop in coolant pressure on the intake side of the coolant pump to the boiling pressure of the coolant results regularly during operation of the engine with a maximum delivery power of the cooling medium pump and thus at the highest pressure difference between the intake side of the coolant pump and the point of connection of the excess-pressure valve. From physical laws, a further pressure drop is not possible, because at leasat the proportion of water in the coolant passes over into steam during the drop to boiling pressure to such an extent which is sufficient to establishing a state of equilibrium between liquid-phase and vapor-phase portions at boiling pressure. The steam bubbles which are thereby sucked-in by the coolant pump, condense again by means of the pressure rise in the pump but the output or delivery power of the coolant pump is reduced by the sucked-in volume of the resulting steam, and in the pump itself a cavitation occurs as a result of the shock-like collapse of the steam bubbles, with its known effects on the lifetime of the pump.

In the arrangement of the filling cap with an excess-pressure valve of about 1 bar excess pressure in the pressure area of the intake side of the cooling medium pump, a pressure results in the cooling circuit also on the intake side of the coolant pump which is higher by the pressure difference between the different arrangements. This pressure, at the most, corresponds directly with the opening value of the excess-pressure valve. With constant warm-up of the coolant and with a constant increase of the delivery power of the coolant pump by a constant rise in the engine rotational speed, the excess pressure on the intake side of the coolant pump thereby also lies with adequate safety above the boiling pressure of the coolant so that a steam bubble formation on the intake side and most far-reachingly also cavitation within the coolant pump are precluded. However, as soon as an at least brief drop of the engine speed, especially down to idling, occurs after attaining the opening value of the excess-pressure valve, a drop in feed pressure as well as an increase in excess pressure on the pump or inlet intake side results. Since, however, at the latter, the opening value of the excess-pressure valve had already been reached, such a volume proportion of the coolant or of the air cushion present in the expansion tank will be discharged through the excess-pressure valve that the excess pressure according to the opening value of the excess-pressure valve will adjust itself in the entire cooling circuit, according to the law of communicating vessels. This is so because only a small pressure difference exists normally between the intake side of the coolant pump and its delivery side during the idling rotational speed, which pressure difference can be neglected in this consideration. If subsequently the engine speed is then again raised to the pre-existing maximum value, then the pressure in the feed or inlet area rises by such a reduced proportion as corresponds to the volume proportion escaped at the excess-pressure valve. The pressure on the intake side of the coolant pump thereby drops simultaneously by a corresponding value to the boiling pressure of the coolant at the given coolant temperature. As a result of this operational development, no safety against boiling on the intake side of the coolant pump and cavitation in the coolant pump exists also with this arrangement and dimensioning of the excess pressure valve, after a one-time drop of the engine rotational speed. Moreover, due to the lower pressure and the thus-reduced delivery power of the coolant pump, an increased steam bubble formation also occurs at the hottest places of the cooling jacket of the engine, above all in the cylinder head. As a result thereof, the heat transfer to the coolant is impaired by an insulating boundary vapor layer, and the efficiency of the cooling system as a whole is diminished. Another contributing factor, finally, is the reduced heat transfer to the surroundings which occurs as a result of the reduced flow velocity in the radiator.

In cooling circuits, in which an excess pressure valve having an opening value of about 1.5 bar excess pressure becomes effective on the intake side of the coolant pump, as is utilized especially in sports car and racing engines, no losses in the efficiency of the cooling system occur even with operating progress described above. However, with such an opening pressure value of the excess-pressure valve, an excess pressure builds up lying far above the durability or service life limit of conventional radiators, during the first warm-up of the coolant and increase of the engine speed described hereinabove in the feed or inlet area of the cooling circuit. For an excess pressure in the feed or inlet area of about 2.5–3 bar results from an excess pressure of about 1.5 bar at the pump intake side, with a pressure difference in the feed or inlet area of about 1–1.5 bar.

It is the aim of the present invention to so construct a cooling circuit for internal combustion engines that a pressure drop on the intake side of the coolant pump to the boiling pressure is avoided and also an excessively high pressure build-up in the feed or inlet area, especially in the feed water box of the radiator, is precluded. Instead, with an unequivocal limitation of both pressure values in the downward and upward directions, a cooling circuit is to be provided which exhibits a far-reachingly constant high efficiency over the entire operating range.

The underlying problems are solved by the present invention by the arrangement and dimensioning of the excess-pressure valve according to which the excess pressure valve is controlled by the area between the cooling jacket, on the one hand, and the radiator valve of the thermostat and/or a radiator-inlet-water box, on the other. The excess pressure valve has an opening value, which lies at least approximately by that difference above the boiling point of the cooling medium at a maximum permissive cooling medium temperature at the suction side of the cooling medium pump, which occurs between the suction side of the cooling medium pump and the place of connection of the excess-pressure valve, when essentially the maximum delivery output of the cooling medium pump exists at fully opened radiator valve of the thermostat. It is assured in this way that the pressure on the suction side of the coolant pump does not drop at this place to the boiling pressure of the coolant at the highest permissible coolant temperature, and that simultaneously the pressure in the feed or inlet area of the cooling circuit does not reach values higher than those heretofore encountered customarily in known cooling circuits.

The specified excess-pressure opening values, the maximum cooling medium temperature at the pump suction side and the pressure difference between suction side of the cooling medium pump and connecting place of the excess-pressure valve thereby provide values for the excess-pressure valve which are adapted to the heretofore customary dimensions of cooling circuits. The arrangement of the excess-pressure valve at the cooling jacket ahead of the discharge thereof provides the advantage, in conjunction with the pressure drop at the outlet of the cooling jacket of the engine, that during the operation of the engine the pressure development of the coolant is within usual limits, but that, after the engine has been turned off, an excess pressure which is higher by the aforementioned pressure drop is available, to avoid after boiling, for the reheating by temperature equalization between the structural parts and the coolant. Since merely a static pressure load of the cooling circuit occurs thereby, such load is maintained within the customary limits.

According to one feature of the present invention, it is possible to arrange the excess-pressure valve separately from its connecting place as a result of which the excess pressure valve is independent in its arrangement from the location of the pressure to be controlled and also the control is made possible at a location by means of cooling medium pressure differing from the control pressure. According to another feature of the present invention, the control line may be constructed at the same time as discharge line for the cooling medium to be discharged through the excess-pressure valve; in the alternative, the control line may be constructed at the same time as vent line which includes in parallel to the excess pressure line, a throttle operatively connected with a venting place and with the suction side of the cooling medium pump.

If the excess pressure valve and/or the throttle are arranged in a filling pipe which is operatively connected with the suction side of the cooling medium pump, if the filling pipe is a component of a venting container and/or of a volume equalization container with expansion air space and if the filling connection and/or a filling connection lid arranged in the filling connection, in addition to the excess-pressure valve and the throttle, also accommodates a vacuum valve, a vent valve, and/or a level float switch, then an advantageous constructiwe combining of different structural parts of the cooling circuit in a filling connection becomes possible as a result of which the structural expenditures of the cooling circuit are reduced. Such an arrangement also enables the combining of all control elements provided for the pressure control and the level indication in the cooling circuit.

According to still another feature of the present invention, a further excess-pressure valve may be connected to the suction side of the cooling medium pump which, by its characteristics, assures that at low engine rotational speeds and low pump delivery outputs caused thereby, a smaller excess pressure is being built up in the cooling circuit than is determined by the aforementioned excess-pressure valve. As a result thereof, on the one hand, the pressure load of the cooling circuit is reduced at partial load operation of the engine, and the venting effect is attained by opening of the further excess-pressure valve with ejection of air possibly accumulated thereat at lower pressure without impairing the advantageous properties of the coolng circuit at low engine rotational speeds or with sudden increase to maximum rotational speed.

A structurally advantageous combining of the two excess-pressure valve functions into a double valve can be achieved according to the present invention if the excess pressure valve and the further excess pressure valve are arranged coaxially opposite one another, if the opening cross section of the two valves is dimensioned in the reverse size ratio as their excess pressure opening values and if both valves are kept closed by a single valve spring in mutually opposite directions. A similar structural simplification is possible if the adjusting motor such as a piston, and the excess-pressure valve are matched selectively to one another as regards their pressure-actuated areas and/or their closure spring forces that either the same or different excess pressure opening values of the inlet and of the pump suction side effect the opening of the further excess-pressure valve. This is possible is selectively the same excess pressure is determined as maximum pressure either in the inlet and at the pump suction side or if a higher excess pressure is determined at the pump suction side than in the inlet and vice versa. The former makes available the same static excess pressure in the entire cooling circuit against an over boiling during reheating of the cooling medium as is limited during the operation of the engine in the inlet as dynamic maximum pressure. The second matching effects during the reheating a higher static pressure than the maximum operating pressure limited in the inlet, and the third matching enables a reversed excess pressure ratio in which the excess pressure at the suction side of the cooling medium pump is adjusted to that approximately average value which results during the decrease from maximum rotational speed to idling speed or standstill of the engine as a result of the disappearance of the pressure difference from the pump delivery output. As a result thereof, in case of rotational speed change, a respective response of one or both excess pressure valve with discharge of cooling medium and/or air and of a vacuum valve for sucking-back as well as therebeyond an excessive rise of the excess pressure in the inlet occurring by reason of the throttling effect of such valves in the inlet with pressure overload of the radiatior are dispensed with. Above all, also at low to middle rotational speeds of the engine, an unnecessarily high pressure build-up is avoided, particularly the lowest excess pressure which adjusts itself thereby, lies thereby still considerably above the boiling pressure of the cooling medium at the pump suction side. Finally, it is additionally assured that with relatively slight excess pressure, a venting of the cooling medium in the pressure area of the suction side of the cooling medium pump is assured, as also during drives over short distance of vehicles with low load. A particularly advantageous constructive design of the doubly controlled excess pressure valve in conjuction with an auxiliary flow equalization tank having an expansion air space is realized if only portions of the air space content are conducted to and from through the excess pressure and the vacuum valve and if the venting auxiliary flow is introduced as venting vortex into the expansion tank in order to separate air residues remaining in the cooling circuit effectively out of the cooling medium.

According to still further features of the present invention, it is possible to match the elasticity of the cooling circuit and pressure development of the cooling medium as a function of temperature change whereby, by suitable selection of elastic line parts such as hose lines, and/or elastically yielding hollow space walls, such as spring or gas-cushion-loaded pistons or diaphragms, an exceeding of the boiling pressure can be precluded during the decrease of the cooling medium temperature by reason of the relatively more rapid pressure drop with relatively rigid walls.

According to still another feature of the present invention, the opening of the filling connection is rendered more difficult or precluded in case of an excess pressure in the cooling circuit whereby both a decrease of the excess pressure functionally disadvantageous for the immediately following operation as also a burning of the handling person through outflowing cooling medium can be far-reachingly precluded.

These and other objects, features and advantages of the present invention will become more apparent from the following description when taken in connection with the accompanying drawing which shows, for purposes of illustration only, several embodiments in accordance with the present invention, and wherein.

Figure 1:
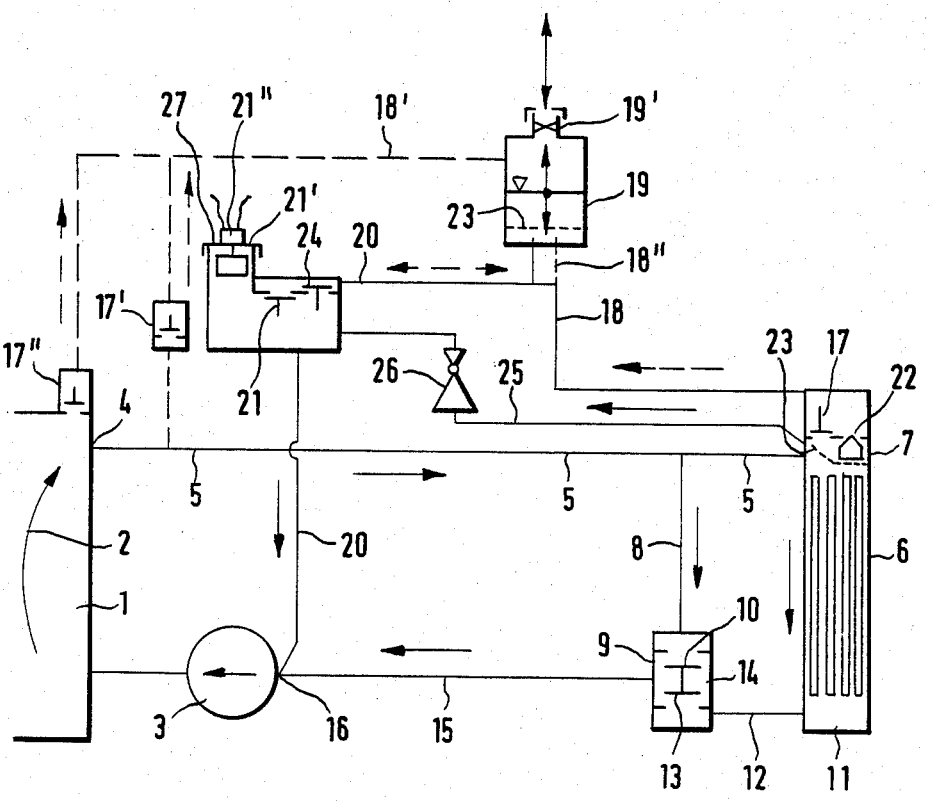
FIG. 1 is a schematic view of a cooling circuit for internal combustion engines with an excess-pressure valve according to this invention in the inlet water box of a radiator.

Referring now to the drawing wherein like reference numerals are used throughout the various views to designate like parts, an internal combustion engine 1 contains a cooling jacket indicated by an arrow 2, into which the cooling medium is fed under pressure by means of a coolant pump 3. At the outlet or discharge 4 of the cooling jacket 2, an inlet 5 is connected to a radiator 6 as a line connection with free passage. The inlet 5 terminates in a radiator inlet water box 7. A bypass 8 is branched off from the inlet 5 and terminates in a mixing thermostat 9, whereby this discharge is controlled by a bypass valve 10 of the mixing thermostat 9. From a radiator return water box 11, a line forming the return 12 from the radiator 6, also leads into the mixing thermostat 9 which contains a radiator valve 13 for controlling the discharge of the return 12. A suction line 15 leads from a mixing chamber 14 of the mixing thermostat 9 and terminates in the suction side 16 of the coolant pump 3.

An excess-pressure valve 17 is arranged at the radiator inlet water box 7 which is connected by means of a discharge line 18 with an expansion tank 19 open with respect to the atmosphere. The expansion tank 19 is equipped with a slotted sealing disk or gasket 19' in its filling opening to prevent evaporation of the coolant. The excess-pressure valve 17 can be connected alternatively (17' or 17'') at the inlet 5 or at the cooling jacket 2 of the engine 1. The expansion tank 19 is connected to the suction side 16 of the coolant pump 3 by way of an auxiliary suction line 20 and a vacuum valve 21, preferably responding pressureless as a check valve. While the discharge line 18 may also be connected alternatively (18') also with the upper area of the interior space of the expansion tank 19, the auxiliary suction line 20 starts from the interior of the expansion tank 19 in proximity to the bottom. The discharge conduit 18, finally, may also terminate in the expansion tank 19 in proximity of the bottom thereof at a separate point (18''). The vacuum valve 21 is combined into one structural unit with a filling stub 21'.

A vent valve 22 is connected to the discharge line 18 in parallel with the excess-pressure valve 17, 17', or 17''; the vent valve, due to its construction as a breather, check or float valve or the like, is thereby opened by the effect of gravity in the presence of air and a pressureless cooling circuit. According to FIG. 1, this vent valve 22 is arranged at the high point of the radiator inlet water box 7 of a vertical-flow radiator 6, from which leaves the discharge line 18. A cross-flow radiator is even better suited for this arrangement for the particular effective venting of the cooling circuit, because only a very small cooling medium flow is produced in the radiator return water box, starting with its radiator inlet water box through the uppermost radiator pipes, which enhances a separation of air in the area of the vent valve which is arranged thereat. The vent valve 22, independently of its location, may be constructed also as a float valve corresponding to the excess-pressure valve 17, 17', or 17'', whose sealing-seat surface is so matched to the weight of the float itself that the float valve also opens in case of air accumulation, if relatively low excess pressure values prevail in the cooling circuit. As a result thereof, a venting of the cooling circuit is thereby still assured even during operation of the engine with a relatively low load. A tight sealing of the cooling circuit with attained venting is also assured thereby so that the vent valve 22 is constantly tightly closed, except after an initial or refilling of the cooling circuit or after any other automatic venting. One or several relatively large-area fine-screen filters 23 additionally avoid valve leakage caused by dirt particles entrained by the coolant.

In the filling connection 21', a further excess-pressure valve 24 is arranged in addition to the excess-pressure valve 21. This further excess-pressure valve 24 is effective by way of the auxiliary suction line 20 directly on the suction side 16 of the coolant pump 3 and thus on the suction pressure thereof. A vent line 25 terminates in the interior space of the filling connection 21', which is connected by means of a throttle 26 to reduce the pressure difference between its connections, on the one hand, to the inlet water box 7 and, on the other hand, to the suction side 15 of the coolant pump 3 by way of the auxiliary suction line 20. A level float switch 21" is installed in the filling connection 21' and/or in the filling connection lid 27 which, in case of air accumulation in the filling connection 21', controls an indicating circuit, and more particularly, independently of whethr or not the expansion tank 19 still contains an optically discernible reservoir.

Filling of the cooling circuit with cooling medium takes place in the filling connection 21'. The engine 1 is filled by way of the auxiliary suction line 20 and the coolant pump 3, while simultaneously the air contained therein escapes to the atmosphere by way of the feed 5, the radiator inlet water box 7, and the vent line 25 into the filling connection 21' as well as by way of the open vent valve 22 and the discharge line 18 into the expansion tank 19. As soon as the level of the inlet 5 has been reached by the coolant in the engine 1 and at the same time in the bypass 8 by way of the suction line 15, the mixing chamber 14, and the open bypass valve 10 of the mixing thermostat 9, the radiator 6 as well as the return 12 up to the radiator valve 13 are also filled; the radiator valve 13 may additionally be equipped with a conventional venting device. The vent valve 22 in the radiator 6 seals off the filled radiator inlet water box 7 with respect to the discharge line 18, while the vent line 25 and the filling connection 21' are filled up completely. The level float switch 21", after closing of the filling connection, controls an electrical indicator lamp on the instruments of the engine or vehicle. The expansion tank 19 can be partially filled with an additional reservoir quantity. The portion of the coolant displaced from the cooling circuit through the excess-pressure valves 17, 17', or 17", and 24 flows into this tank during thermal expansion owing to environmental and cooling circuit temperature fluctuations, as well as, above all, owing to operational warm-up.

During operation of the internal combustion engine 1, commencing usually after a relatively long cooling-off period with a cold start, at which the likewise cooled-off content of coolant of the entire cooling circuit has a certain minimum volume, the expansion tank 19 contains a corresponding minimum content. This is so as, during the preceding cooling-off, a cooling medium volume corresponding to the shrinkage in volume flows from the expansion tank 19 through the auxilary suction line 20 and through the vacuum valve 21 as well as through the coolant pump 3, into the cooling circuit, otherwise closed off all around by the excess pressure valve 17, which is composed of the cooling jacket 2, of the inlet 5, of the radiator 6, of the return 12, of the suction line 15, and of the bypass 8. The content of the expansion tank 19 is, for this reason, so dimensioned that at the locally normally prevailing lowest ambient temperatures, a complete emptying of the expansion tank 19 is far-reachingly precluded. However, the cooling circuit is still operable unchanged even if, at extraordinarily low ambient temperatures, a certain amount of air is sucked into the cooling circuit because, owing to the volume expansion of the coolant occurring during warm-up of the engine, this proportion of air is displaced again into the expansion tank 19 through the excess-pressure valve 17 before the operating temperature has been reached. The switching path of the level float switch 21" can be adapted to this change in volume, but also to a minimum air volume in the filling connection 21'.

The total volume of the expansion tank 19 is finally determined additionally from the total content of the cooling circuit, the highest possible thermal expansion of the coolant in the cooling circuit and an additional storage volume for a possible ejection quantity through the excess-pressure valve 17 due to overheating.

During starting of the cooled-off engine, the first rotational speed rise leads immediately to the build-up of a delivery level for the coolant pump 3 which effects, on the one hand, a drop in the pump suction pressure to below the ambient pressure existing in the entire cooling circuit prior to the start, and, on the other hand, a build-up of an excess pressure in the cooling circuit sections connected downstream of the coolant pump 3, namely cooling jacket 2, inlet 5, bypass 8, radiator 6, and return 12. While this excess pressure does not attain the opening pressure value of the excess-pressure valve 17, cooling medium is sucked from the expansion tank 19 into the cooling circuit through the vacuum valve 21, responding to the slightest pressure difference and through the auxiliary suction line 20, until ambient pressure is reached on the suction side 16 of the coolant pump 3. During this operation, the excess pressure in the parts of the cooling circuit located downstream of the coolant pump 3 continues to rise at the same time. The elastic hose lines and any possible residual air inclusions in this area make it possible for the volume of coolant contained therein to increase, which is sucked-in during this operation from the expansion tank 19.

During the further operation of the internal combustion engine 1, the coolant temperature rises continuously due to the heat transfer to the coolant in the cooling jacket 2, until the opening temperature value of the mixing thermostat 9 of about 80° C. is reached. This is followed by the control range of the mixing thermostat 9 with increasing opening of the radiator valve 13 and closing of the bypass valve 10 as well as likewise increasing flow through the radiator 6. A further rise in temperature up to above about 95° C. leads past the control range of the mixing thermostat 9, with closed bypass valve 10 to a through-flow solely through the radiator 6 with a thereby increased through-flow quantity, flow velocity, heat removal and also increased flow resistance and pressure build-up in the inlet 5 and in the radiator inlet water box 7. Depending on volume content and elasticity of the cooling circuit, especially of the hose lines of the inlet 5, of the bypass 8, of the return 12, and of the suction line 15, as well as furthermore depending on the initial temperature of the coolant content during the starting procedure, and depending on the instantaneous engine speed, the opening pressure value of the excess-pressure valve 17 or of the excess-pressure valve 24 is reached more or less early in time before or after the opening of the radiator valve 13 of the mixing thermostat 9. The engine speed is therefore determinative because the occurring delivery level of the coolant pump 3 at low to medium speeds enables first a response of the excess-pressure valve 24, which responds with an excess pressure opening value that is lower than the excess pressure opening value of the excess-pressure valve 17 by precisely that pressure difference which builds up between standstill of the engine or idling seed and maximum rotational speed at the place of the excess-pressure valve 17, 17' or 17". Thus, at low engine rotational speeds, the excess-presure valve 24 will respond in each case, which is connected on the suction side 16 of the coolant pump 3 by way of the auxiliary suction line 20. Only in the region of maximum speed of the engine the excess pressure opening value of the excess-pressure valve 17, 17', or 17'' is determinative. However, on the other hand, lower pressures occur thereby due to the flow resistances of the cooling circuit in the flow direction downstream of the excess-pressure valve 17, 17' or 17''. The pressure on the suction side 16 of the coolant pump 3 is thereby even substantially below the excess pressure opening value of the excess-pressure valve 24 effective thereat. This is due to the suction effect of the coolant pump 3 and due to the elasticities distributed over the entire cooling circuit, especially of the hose lines. At lowest idling speed of the engine, the pressure differences are very small and thus, just as during standstill of the engine 1, the entire cooling circuit assumes an excess pressure corresponding to the opening value of the excess-pressure valve 24.

Thus, on the whole, an internal pressure may occur regularly in the cooling circuit, which ranges from ambient pressure to the opening pressure value of the excess pressure valve 17 as well as therebeyond an excess pressure exceeding this first-mentioned pressure during operation of the engine 1 in the cooling jacket 2 and in the inlet 5 as well as in the bypass 8, which excess pressure is dependent on the flow resistance of the cooling circuit. The unequivocal limitation of the maximum and minimum pressure values in the radiator inlet water box 7 and on the suction side 16 of the coolant pump 3 avoids, on the one hand, a pressure overload of the radiator 6 with corresponding overdimensioning in its strength, and, on the other hand, a pressure drop with increased danger of cavitation in the coolant pump.

The excess pressure, which is uniformly available in the entire cooling circuit by way of the excess-pressure valve 24 after turning off the engine, counteracts vapor formation during the reheating and/or temperature equalization between the engine and the coolant. A pressure overload on the cooling circuit structural parts is not caused by this relatively low, exclusively statically effective excess pressure. The higher, dynamically effective excess pressure determined by the excess-pressure valve 17, 17', or 17'' is limited to the operation of the engine 1 with relatively high engine speeds, at which the pressure difference between the suction side 16 of the coolant pump 3 and the connection point of the excess-pressure valve 17, 17', or 17'' is larger than the difference of the excess pressure opening values between the excess-pressure valves 17, 17', or 17'', on the one hand, and 24, on the other hand, arranged at these locations. This higher excess pressure is thus limited to a relatively small proportion of the operationg period of the engine, especially during the driving of vehicles. The long-term lifetime and durability of the cooling circuit structural parts, especially of the radiator and of the hose lines, is thereby enhanced.

During a cooling of the engine 1 and of the coolant by reason of a reduction of the engine load, the excess pressure in the cooling circuit also drops due to the then-negative thermal expansion of the coolant. In order that the excess pressure does not drop thereby below the boiling pressure at the respective temperature of the coolant, especially on the suction side of the coolant pump 3, the elastic walls of the cooling circuit, especially the hose lines and any elastic gas or air cushion possibly provided or an elastic piston or diaphragm spring device which may be included, are correspondingly matched to each other in their total elasticity.

With the beginning of the operation of the engine 1 after filling the cooling circuit with coolant, an automatic venting of the cooling circuit from residual air components also begins, which have remained at various locations during the filling or which pass during operation into the cooling circuit, for example, through the seals of the coolant pump 3, which are briefly subjected to a vacuum during the cold start. These residual air components are flushed by the flow of coolant from the engine 1 through the free passage of the inlet 5 into the radiator inlet water box 7, into which only the relatively small venting flow, determined by the throttle 26, passes during warm-up of the engine with closed radiator valve 13 of thermostat 9. As a result thereof, a large portion of the residual air can separate from the coolant downstream of the bypass 8 in the remainder of the inlet 5 and in the radiator inlet water box 7 with a calm flow and, in case of a relatively large accumulation, can be discharged through the then-opening vent valve 22 by way of the discharge line 18 and possibly 18'' to the expansion tank 19. A corresponding volume of coolant can simultaneously be sucked-in through the auxiliary suction line 20 and the vacuum valve 21 into the filling connection 21', which takes place due to the effect of the pump suction pressure by way of the auxiliary suction line 20 leading to the suction side 16. The venting stream flows through the vent line 25 and the throttle 26 to the filling pipe 21', which conducts the residual relatively small air components remaining into the filling connection and there places the same ahead of the additional excess-pressure valve 24. As soon as the excess pressure value of about 1.5 bar of this excess-pressure valve 24 has been reached by the warm-up of the engine 1 and of the coolant as well as by the thus-resulting thermal expansion and pressure increase of the coolant, the excess-pressure valve 24 opens and allows the collected residual air to flow through the auxiliary suction line 20 into the expansion tank 19. This operation continues and/or is repeated until the thermal equilibrium condition of the cooling circuit has been reached. A venting also occurs if the excess pressure opening value of the excess-pressure valve 17 in the radiator inlet water box has been reached. However, no previously accumulated residual air components are discharged, but merely residual air components directly contained or dissolved in the exiting coolant are thereby discharged into the expansion tank 19 and thus into the atmosphere. An additional venting and discharging of coolant with residual air from the filling connection 21' into the expansion tank 19 through the excess-pressure valve 24 also always occurs if, after a warm-up operating period with a high engine rotational speed of about 5,000–6,000 rpm and a high pressure difference of about 1 bar between radiator inlet water box 7 and suction side 16 of the coolant pump 3, the engine speed drops considerably, especially down to idling speed. This is so as the excess pressure opening value of about 2 bar of the excess pressure valve 17 is thereby reached initially at least approximately, while the value falls substantially below the excess pressure opening value of about 1.5 bar of the additional excess-pressure valve 24. When the engine speed drops, the excess pressure values then far-reachingly equalize to one another so that the excess pressure in the filling connection 21' rises approximately to the excess pressure opening value of the excess-pressure valve 24 located thereat. During the further warm-up of the coolant by temperature equalization between the highly heated engine 1 and the coolant, which normally takes place subsequently, the excess pressure opening value of the excess-pressure valve 24 is exceeded by the corresponding thermal expansion of the coolant. The residual air which may have been present in the filling connection 21' until then is thereby discharged, together with a proportion of coolant, into the expansion tank 19.

The air contained as bubbles or solution in the coolant is discharged in expansion tank 19 into the atmosphere under atmospheric pressure and at ambient temperature, for example, the engine space temperature of vehicles. A sealing disk 19', slotted without cutouts, permits an air outlet and inlet from and into the expansion tank 19, respectively, for the purpose of volume equalization, but prevents a constant air movement by convection flow. As a result thereof, evaporation losses of coolant are most far-reachingly precluded.

Figure 2:
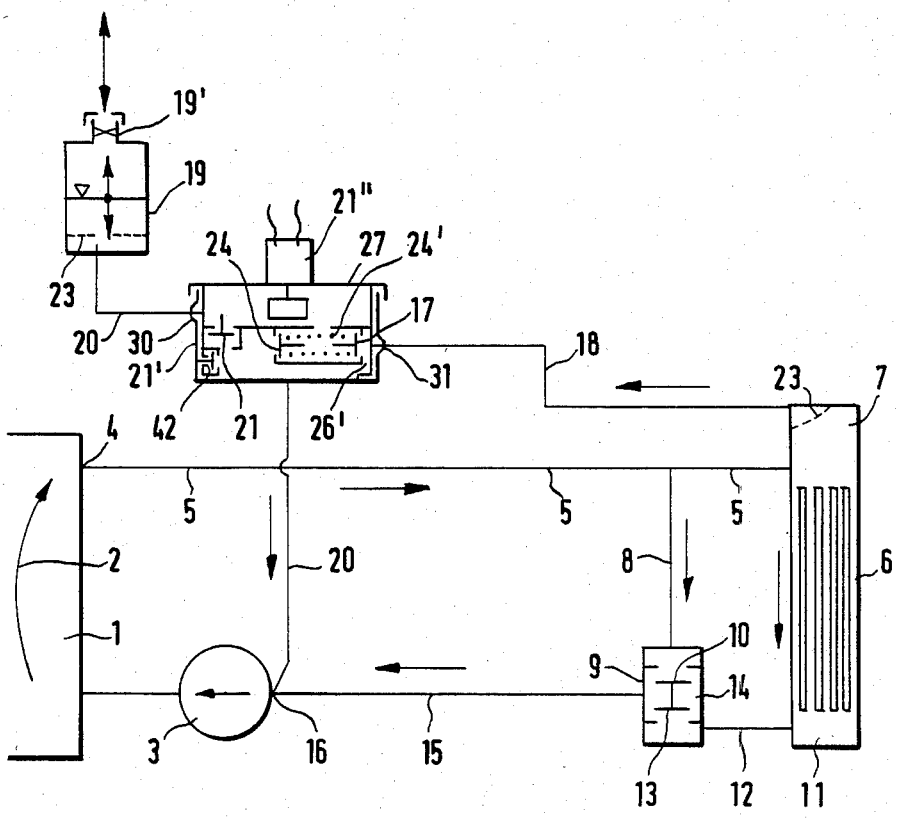
FIG. 2 is a schematic view of a cooling circuit according to FIG. 1 with an excess-pressure valve according to this invention in a filing closure device connected to the suction side of the coolant pump.
Figure 3:
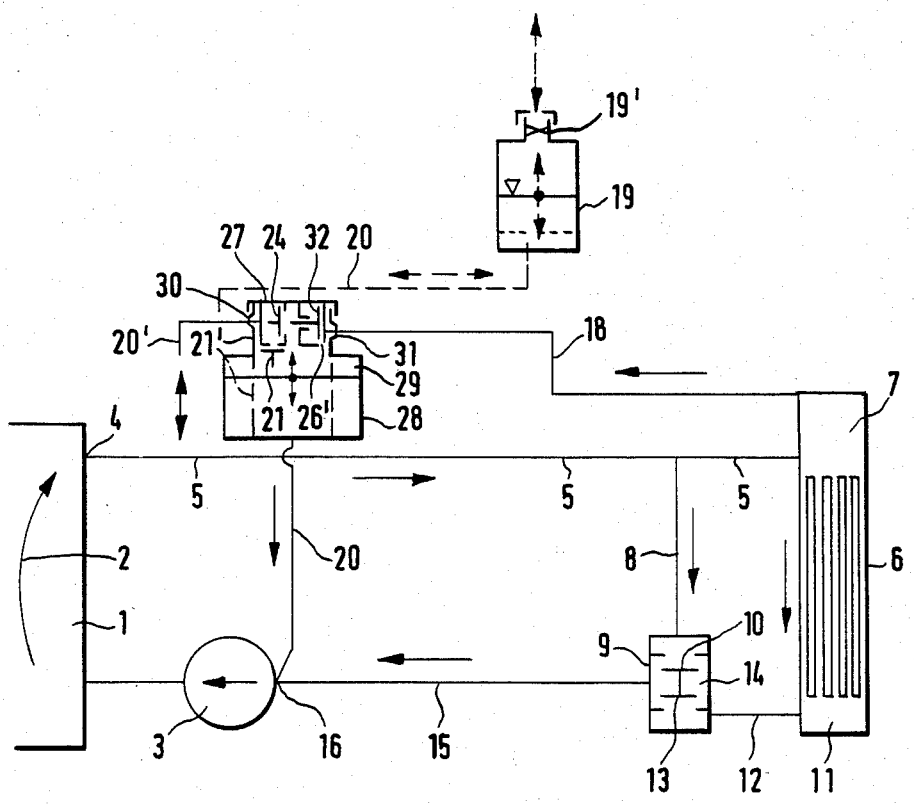
FIG. 3 is a schematic view of a cooling circuit according to FIGS. 1 and 2 with an excess pressure valve in accordance with this invention, which is connected to the suction side of the coolant pump, but additionally is controlled by way of an adjusting motor by the pressure in the feed or inlet water box of the radiator.

The arrangements of the cooling circuit of FIGS. 2 and 3 correspond both in structure as well as in function most far-reachingly to the arrangement of FIG. 1. Only the two excess-pressure valves 17 and 24 are combined thereby in the filling connection 21', respectively, in the closure lid or cap 27 of the filling connection 21' of a by-pass expansion tank 28 with air space 29. Furthermore, the vent valve 22 has been omitted; the discharge line 18 is connected with the filling connection 21', respectively, the cap 27 thereof by way of the excess pressure valve 17, and the throttle 26' is arranged in the lid or cover 27 in parallel to the excess-pressure valve 17.

FIG. 2 shows alternative connections 18' of the discharge line 18 at the inlet 5 and at the cooling jacket 2 corresponding to the alternative arrangements of the excess-pressure valve 17' and 17''. The excess-pressure valves 17 and 24 in FIG. 2 are actuated in opposed closing directions by a single valve spring 24'. The different excess pressure opening values of about 1.5 and 2 bar, respectively, are obtained by an inversely proportional dimensioning of the opening cross sections of the two valves. The respective connection of the discharge line 18 and of the auxiliary suction line 20, respectively, of the vapor discharge line 20', alternatively provided in FIG. 3, at the lid 27 takes place by way of sealed annular grooves 30 and 31 which are arranged between the filler pipe 21' and the cover or lid 27.

In FIG. 3, the bypass expansion tank 28 is indicated in dashed lines alternatively also as a filler pipe 21' without air space 29. The vapor discharge line 20' terminating in the atmosphere is thus to be provided exclusively in combination with an air space 29 whereas the expansion tank 19 and the auxiliary suction line 20 can cooperate with a bypass expansion tank 28 without air space 29 as well as with a filler pipe 21' without air space.

The excess-pressure valve 17 in FIG. 2 has the same function as in FIG. 1. However, in FIG. 2, this valve is not controlled directly by the excess pressure in the radiator inlet water box 7, but instead by way of the discharge line 18. The throttle 26' is arranged in the cover or lid 27 in parallel to the excess-pressure valve 17 in such a way that the pressure drop in the throttle 26' cannot have an effect on the function of the excess-pressure valve 17. The discharge line 18 thus also acts as control line for the excess-pressure valve 17 and as a vent line for the filling and operating venting into the filler pipe 21'.

Figure 4:
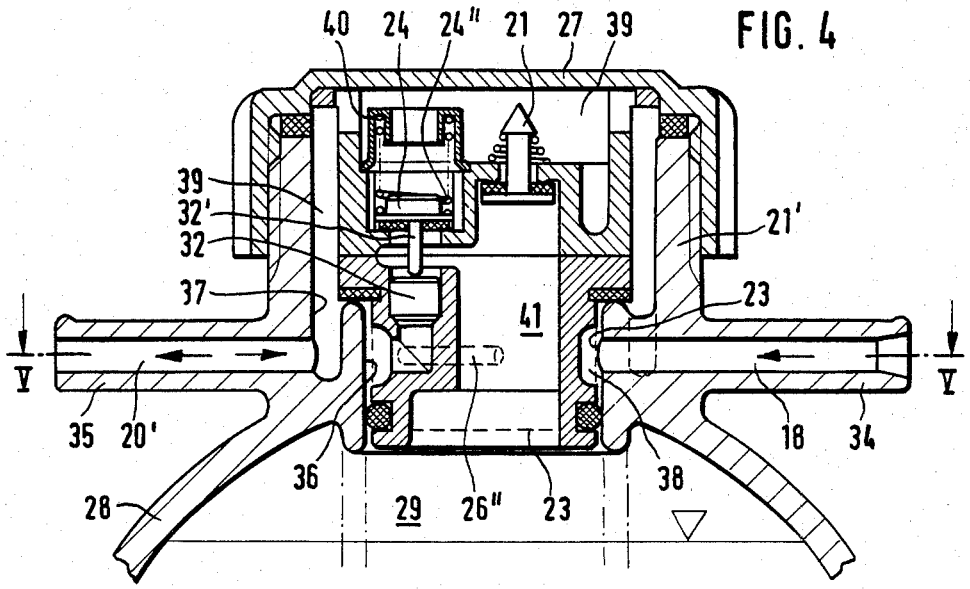
FIG. 4 shows a filling stub with valves installed according to this invention in the lid or cover for a bypass expansion tank with an expansion air space according to FIG. 3.
Figure 5:
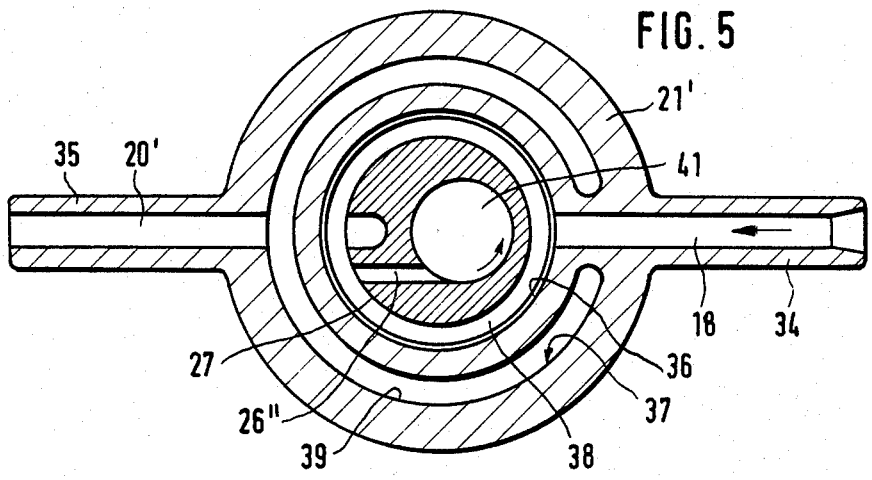
FIG. 5 is a cross-sectional view, taken along line V—V of FIG. 4.

In the construction according to FIGS. 3–5, differing from FIG. 2, instead of a further excess-pressure valve 24, a piston 32 acting as adjusting motor is arranged in the cover or lid 27 of the filler pipe 21'. The piston 32 is acted upon by the excess pressure in the radiator inlet water box 7 by way of the discharge line 18, which is effective only as control and vent line. A piston rod 32' transmits the control movement of the piston 32 to the excess-pressure valve 17. The effective cross sections of the piston 32 and of the excess-pressure valve 17 are matched to the valve spring 24' of the excess-pressure valve 17 in such a way that the excess-pressure valve 17, for example, at an excess pressure of about 2 bar on the suction side 16 of the coolant pump 3, is directly opened by this excess pressure, whereas this valve is actuated by the predominant pressure force of the piston 32 by way of the piston rod 32' at an excess pressure of about 1 bar on the suction side 16 and simultaneously at an excess pressure of about 2 bar on the radiator inlet water box 7. In this manner, during standstill or idling of the engine 1 and thus with a lacking or only small delivery output of the coolant pump 3, a static pressure of about 2 bar is made available in the entire cooling circuit for the reheating operation with temperature and pressure rise against an afterboiling in the engine. During operation of the engine 1, in contrast thereto, the pressure development in the radiator inlet water box 7 acted upon with relatively high local excess pressure, is also limited to the dynamically effective maximum value of about 2 bar. Lower excess pressure values thereby occur at the suction side 16 of the coolant pump 3 and at all locations in the cooling circuit which, in the flow direction, are disposed downstream of the radiator inlet water box 7. With a maximum pressure difference of about 1 bar between suction side 16 and radiator inlet water box 7, the excess pressure at the suction side 16 thus does not drop below about 1 bar, so that the pressure value cannot drop below the boiling pressure at the usual maximum temperatures at this point of about 120° C.

In FIGS. 4 and 5, the structural design and arrangement of the filler pipe 21' and of the associated cap-like lid or cover 27 adapted to be screwed-on is illustrated at the bypass expansion tank 28 with an air space 29, respectively, at a filler pipe 21' without air space 29. The filler pipe 21' is constructed as a one-piece plastic molded part, to which are integrally formed-on one hose connection each 34 and 35 for the discharge line 18 and for the overflow line 20', respectively, auxiliary suction line 20. The discharge line 18 terminates in a narrower, lower cylindrical portion 36 of the inner wall 37 of the filler pipe, to which is coordinated an annular groove 38, sealed on both sides, of the cap-like cover or lid 27. The overflow, respectively, auxiliary suction line 20', respectively, 20, terminates in a further, upper cylindrical portion 39, which is connected with an upper space of the cap-like lid or cover 27 outside of the excess-pressure and vacuum valves 17 and 22. The cap-like cover or lid 27 is constructed as two-partite plastic molded part which is glued or welded together. The cap-like cover or lid 27, in addition to being provided with the bores and connecting apertures for the excess-pressure valve 17 with valve spring 24'' and spring sleeve 40, is provided with a cylindrical air separating space 41 for the piston 32 and the associated last section of the discharge line 18 effective as control line, and for the vacuum valve 22, in which terminates tangentially a narrow vent bore 26'' as the corresponding throttle 26' in FIG. 3. The centrifugal flow thus produced during operation enhances separation of the residual air entrained in the venting flow.

FIG. 2 shows schematically a locking device 42 which locks the cap-like cover or lid 27 against a dangerous opening when excess pressure exists in the cooling circuit. This locking device consists of a locking piston or the like which retains a locking pin in engagement with a ribbed, serrated or similarly constructed area of the inner wall of the filler pipe 21'. The locking effect is enhanced with increasing excess pressure and makes it difficult, respectively, precludes a careless opening of the cap-like cover or lid 27, with an escape of hot water or steam to be expected thereby and with the danger of burn or scald injuries to the handling person.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A cooling circuit for internal combustion engines, comprising a coolant pump at an inlet to a cooling jacket of an engine, a radiator constructed as a heat-exchanger for the transference of heat between engine coolant and surrounding air, an inlet of said radiator being connected to an outlet of the cooling jacket, and a return of said radiator being connected to the suction side of the coolant pump, a radiator valve of a thermostat arranged between the outlet of the cooling jacket and the suction side of the coolant pump in one of the inlet and return of the radiator, and an excess-pressure valve means operable for limiting maximum pressure, the excess-pressure valve means being controlled by the area between the cooling jacket and at least one of the radiator valve and a radiator inlet water box, the excess-pressure valve means having an excess pressure opening value which lies above the boiling pressure of the coolant, at a maximum permissive coolant temperature on the suction side of the coolant pump, by at least approximately that pressure difference which occurs between the suction side of the coolant pump and a connecting point of the excess-pressure valve means when essentially the maximum delivery output of the coolant pump occurs with a fully opened radiator valve of the thermostat.

2. A cooling circuit according to claim 1, wherein the excess-pressure valve means has an excess pressure opening value of about 1.5–2.2 bar at a maximum permissible coolant temperature on the pump suction side of about 90°–120° C. and with a pressure difference between the suction side of the coolant pump and the connecting point of the excess-pressure valve means of about 0.5–1.2 bar.

3. A cooling circuit according to claim 1, wherein the excess-pressure valve means is arranged at a location remote from its connection point and is acted upon by excess pressure by way of a control line.

4. A cooling circuit according to claim 3, wherein the control line is constructed simultaneously with discharge line for coolant to be discharged through the excess-pressure valve means.

5. A cooling circuit for internal combustion engines, comprising a coolant pump at an inlet to a cooling jacket of an engine, a radiator constructed as a heat-exchanger for the transference of heat between engine coolant and surrounding air, an inlet of said radiator being connected to an outlet of the cooling jacket, and a return of said radiator being connected to the suction side of the coolant pump, a radiator valve of a thermostat arranged between the outlet of the cooling jacket and the suction side of the coolant pump in one of the inlet and return of the radiator, and an excess-pressure valve means operable for limiting maximum pressure, the excess-pressure valve means being connected to the cooling jacket upstream of an outlet of the cooling jacket.

6. A cooling circuit according to claim 5, wherein the excess-pressure valve means is arranged at a location remote from its connection place and is acted upon by excess pressure by way of a control line.

7. A cooling circuit according to claim 6, wherein the control line is constructed simultaneously with a discharge line for coolant to be discharged through the excess pressure valve means.

8. A cooling circuit according to claim 6, wherein the control line is constructed simultaneously with a vent line which includes, in parallel to the excess-pressure valve means, a throttle means in communication with a venting place and with the suction side of the coolant pump.

9. A cooling circuit according to claim 6, wherein at least one of excess-pressure valve means and throttle means is arranged in a filler pipe means which is in communication with the suction side of the coolant pump.

10. A cooling circuit according to claim 9, wherein the filler pipe means is part of at least one of a venting tank and a volume-equalizing tank with expansion air space.

11. A cooling circuit according to claim 10, wherein at least one of the filler pipe means and a cap-like cover means arranged in the filler pipe means accommodate, in addition to the excess-pressure valve means and the throttle means, at least one of a vacuum valve means, a vent valve means, and a level float switch means.

12. A cooling circuit according to claim 11, wherein a further excess-pressure valve means is connected to the suction side of the coolant pump, the excess pressure opening value of the further excess-pressure valve means lies above the boiling pressure of the coolant at the maximum permissible coolant temperature by at least approximately that pressure difference which occurs on the pump suction side between the lowest delivery output of the pump and the highest delivery output of the pump at minimum and maximum rotational speed of the engine.

13. A cooling circuit according to claim 12, wherein said pressure difference is generally 0.2–0.6 bar.

14. A cooling circuit according to claim 12, wherein the excess-pressure valve means and the further excess-pressure valve means are arranged coaxially mutually opposite one another, opening cross sections of the two valve means are dimensioned in their size at a ratio inverse to their excess pressure opening values, and both valve means are held closed in opposite directions by a single valve spring.

15. A cooling circuit according to claim 12, wherein a single excess-pressure valve means controlled on the suction side of the coolant pump is actuated both by the excess pressure in the area of the inlet between the cooling jacket and the radiator by way of a control line and by an adjusting motor means as well as by the excess pressure on the suction side of the coolant pump.

16. A cooling circuit according to claim 15, wherein the adjusting motor means and excess-pressure valve means are selectively matched to each other with respect to one of their pressure-actuated areas and their closing spring forces in such a way that either the same or differing excess pressure opening values of the inlet and of the pump suction side effect opening of the excess-pressure valve means.

17. A cooling circuit according to claim 15, wherein the adjusting motor means and the excess-pressure valve means as well as a vacuum valve means are arranged in a cap-like cover means of the filler pipe means of an expansion tank which contains an air space as thermal expansion and pressure equalization space, the adjusting motor means is acted upon by a control line which, at one end, is connected to a high-level point of at least one of the inlet and the radiator, which terminates in the filler pipe cover means by way of an annular groove and which terminates in parallel to the adjusting motor means in a throttled vent bore, which, in turn, terminates tangentially in an approximately cylindrical air-separating space of the cap-like cover means, the expansion tank includes a filler pipe means and one hose connection each for the control line and an overflow line which terminate in the interior of the expansion tank, in a portion of a cylindrical inner wall of the filler pipe means within the area of an annular groove of the cap-like cover means and, respectively, in a cylindrical inner wall of a hollow space of the filler pipe means and of the cap-like cover means thereof lying outside of the valve means.

18. A cooling circuit for internal combustion engines, comprising a coolant pump at an inlet to a cooling jacket of an engine, a radiator constructed as a heat-exchanger for the transference of heat between engine coolant and surrounding air, an inlet of said radiator being connected to an outlet of the cooling jacket, and a return of said radiator being connected to the suction side of the coolant pump, a radiator valve of a thermostat arranged between the outlet of the cooling jacket and the suction side of the coolant pump in one of the inlet and return of the radiator, and an excess-pressure valve means operable for limiting maximum pressure, the excess pressure opening value of the excess-pressure valve means and the elasticity of the hollow spaces and lines containing at least one of the coolant and air under excess pressure are matched to the thermal expansion of the coolant in such a way that the excess pressure on the suction side of the coolant pump, at varying average temperature of the coolant and delivery output of the coolant pump, lies always above the boiling pressure of the coolant.

19. A cooling circuit according to claim 18, wherein at least one of the excess-pressure valve means and a throttle means is arranged in a filler pipe means which is in communication with the suction side of the coolant pump.

20. A cooling circuit according to claim 12, wherein the filler pipe means is part of at least one of a venting tank and a volume-equalizing tank with expansion air space.

21. A cooling circuit according to claim 19, wherein at least one of the filler pipe means and a cap-like cover means arranged in the filler pipe means accommodate, in addition to the excess-pressure valve means and the throttle means, at least one of a vacuum valve means, a vent valve means, and a level float switch means.

22. A cooling circuit for internal combustion engines, comprising a coolant pump at an inlet to a cooling jacket of an engine, a radiator constructed as a heat-exchanger for the transference of heat between engine coolant and surrounding air, an inlet of said radiator being connected to an outlet of the cooling jacket, and a return of said radiator being connected to the suction side of the coolant pump, a radiator valve of a thermostat arranged between the outlet of the cooling jacket and the suction side of the coolant pump in one of the inlet and return of the radiator, and an excess-pressure valve means operable for limiting maximum pressure, and locking means for cooperating with a filler pipe cap-like cover means, which makes it difficult, respectively, precludes the opening thereof at an existing excess pressure.

23. A cooling circuit for internal combustion engines, comprising a coolant pump at an inlet to a cooling jacket of an engine, a radiator constructed as a heat-exchanger for the transference of heat between engine coolant and surrounding air, an inlet of said radiator being connected to an outlet of the cooling jacket, and a return of said radiator being connected to the suction side of the coolant pump, a radiator valve of a thermostat arranged between the outlet of the cooling jacket and the suction side of the coolant pump in one of the inlet and return of the radiator, and an excess-pressure valve means operable for limiting maximum pressure, the excess-pressure valve means being arranged at a location remote from its connection point and being acted upon by excess pressure by way of a control line, the control line being constructed simultaneously with a discharge line for coolant to be discharged through the excess-pressure valve means and a vent line which includes, in parallel to the excess-pressure valve means, a throttle means in communication with a venting place and with the suction side of the coolant pump.

24. A cooling circuit for internal combustion engines, comprising a coolant pump at an inlet to a cooling jacket of an engine, a radiator constructed as a heat-exchanger for the transference of heat between engine coolant and surrounding air, an inlet of said radiator being connected to an outlet of the cooling jacket, and a return of said radiator being connected to the suction side of the coolant pump, a radiator valve of a thermostat arranged between the outlet of the cooling jacket and the suction side of the coolant pump in one of the inlet and return of the radiator, and an excess-pressure valve means operable for limiting maximum pressure, the excess-pressure valve means being controlled by the area between the cooling jacket and at least one of the radiator valve and a radiator inlet water box, and a further excess-pressure valve means connected to the suction side of the coolant pump, the excess pressure opening value of the further excess-pressure valve means lying above the boiling pressure of the coolant at the maximum permissible coolant temperature by at least approximately that pressure difference which occurs on the pump suction side between the lowest delivery output of the pump and the highest delivery output of the pump at minimum and maximum rotational speed of the engine.

25. A cooling circuit according to claim 24, wherein the excess-pressure valve means and the further excess-pressure valve means are arranged coaxially mutually opposite one another, opening cross sections of the two valve means are dimensioned in their size at a ratio inverse to their excess pressure opening values, and both valve means are held closed in opposite directions by a single valve spring.

26. A cooling circuit according to claim 24, wherein a single excess-pressure valve means controlled on the suction side of the coolant pump is actuated both by the excess pressure in the area of the inlet between the cooling jacket and the radiator by way of a control line and by an adjusting motor means as well as by the excess pressure on the suction side of the coolant pump.

27. A cooling circuit according to claim 26, wherein the adjusting motor means and excess-pressure valve means are selectively matched to one of each other with respect to their pressure-actuated areas and their closing spring forces in such a way that either the same or differing excess pressure opening values of the inlet and of the pump suction side effect opening of the excess-pressure valve means.

28. A cooling circuit according to claim 26, wherein the adjusting motor means and the excess-pressure valve means, as well as a vacuum valve means, are arranged in a cap-like cover means of the filler pipe means of an expansion tank, which contains an air space as thermal expansion and pressure-equalization space, the adjusting motor means is acted upon by a control line which, at one end, is connected to a high-level point of at least one of the inlet and the radiator which terminates in the filler pipe cover means by way of an annular groove and which terminates in parallel to the adjusting motor means in a throttled vent bore which, in turn, terminates tangentially in an approximately cylindrical air separating space of the cap-like cover means, the expansion tank includes a filler pipe means and one hose connection each for the control line and an overflow line which terminate in the interior of the expansion tank in a portion of an annular groove of the cap-like cover means and, respectively, in a cylindrical inner wall of a hollow space of the filler pipe means and of the cap-like cover means thereof lying outside of the valve means.

* * * * *